United States Patent [19]

Norris et al.

[11] 4,017,993

[45] Apr. 19, 1977

[54] ROTARY FILE

[75] Inventors: H. Coleman Norris, Pewaukee; Gordon D. Kelly, Elm Grove, both of Wis.

[73] Assignee: Columbian Art Works, Inc., Milwaukee, Wis.

[22] Filed: Nov. 20, 1975

[21] Appl. No.: 633,927

Related U.S. Application Data

[63] Continuation-in-part of Ser. No. 467,902, May 8, 1974, abandoned, which is a continuation-in-part of Ser. No. 316,497, Dec. 19, 1972, abandoned.

[52] U.S. Cl. ..... 40/68; 40/68.6

[51] Int. Cl.[2] ..... G09F 11/02

[58] Field of Search ..... 40/68, 68.4, 74; 312/185–189, 126; 211/58

[56] References Cited

UNITED STATES PATENTS

| | | | |
|---|---|---|---|
| 2,389,923 | 11/1945 | Miller | 40/68.6 |
| 2,429,729 | 10/1947 | Miller | 40/68.6 |
| 2,441,711 | 5/1948 | Nero | 40/68.6 |
| 2,522,986 | 9/1950 | Bruen | 40/68 |
| 2,731,966 | 1/1956 | Neilsen | 40/68.6 |
| 2,748,775 | 6/1956 | Neilsen | 40/68.6 |
| 3,195,242 | 7/1965 | Ward et al. | 40/86 R X |
| 3,413,062 | 11/1968 | Zillmer | 40/68 X |
| 3,734,587 | 5/1973 | Karper | 312/186 |

*Primary Examiner*—G.E. McNeill
*Assistant Examiner*—John H. Wolff
*Attorney, Agent, or Firm*—Ira Milton Jones and Associates

[57] ABSTRACT

A card file having a rotor with radiating arms, each of which has a card-carrying tray detachably connected thereto. The rotor is mounted in a housing for rotation about a horizontal axis so that each tray can be brought to a detent-defined viewing position at which the tray is disposed in a substantially horizontal attitude affording ready access to the file cards carried thereby. Inwardly facing ribs on the lower portion of the housing have their edges concentric to the axis of the rotor to be engagable by the outer extremities of the trays as they traverse the lower portion of their orbit upon rotation of the rotor, to thereby prevent detachment of the trays from the rotor arms. The various components of the rotor are held assembled with one another and with the housing entirely without reliance upon screws, bolts, rivets or the like. Upon removal of the card trays from the rotor, they can be connected in side-by-side relationship by interengaging dovetails to form a rigid desk unit which facilitates reference to the contents of all of the trays.

14 Claims, 23 Drawing Figures

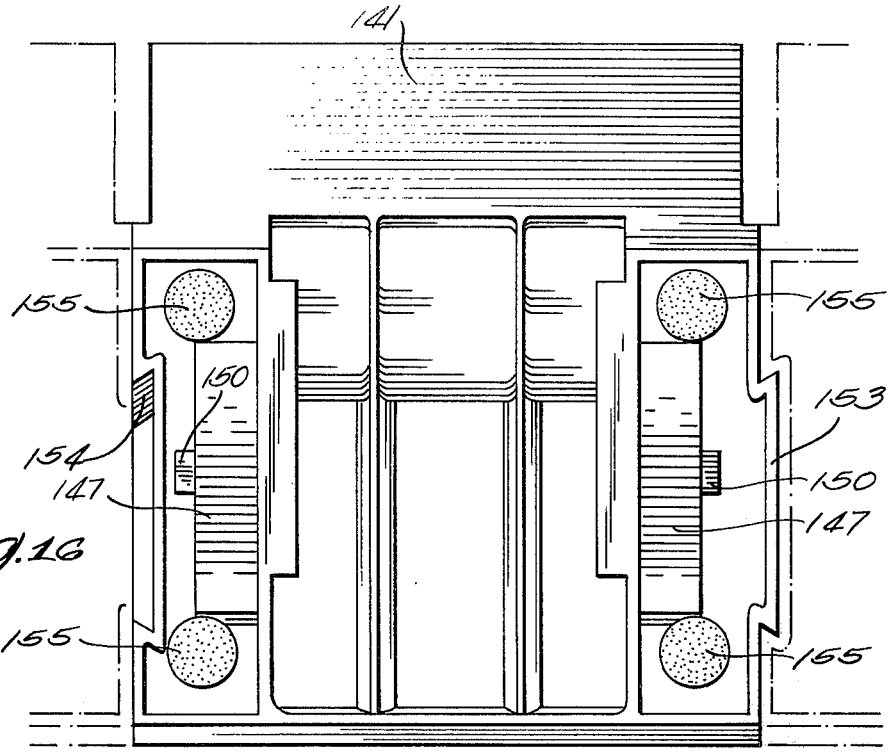
Fig. 16
Fig. 5A
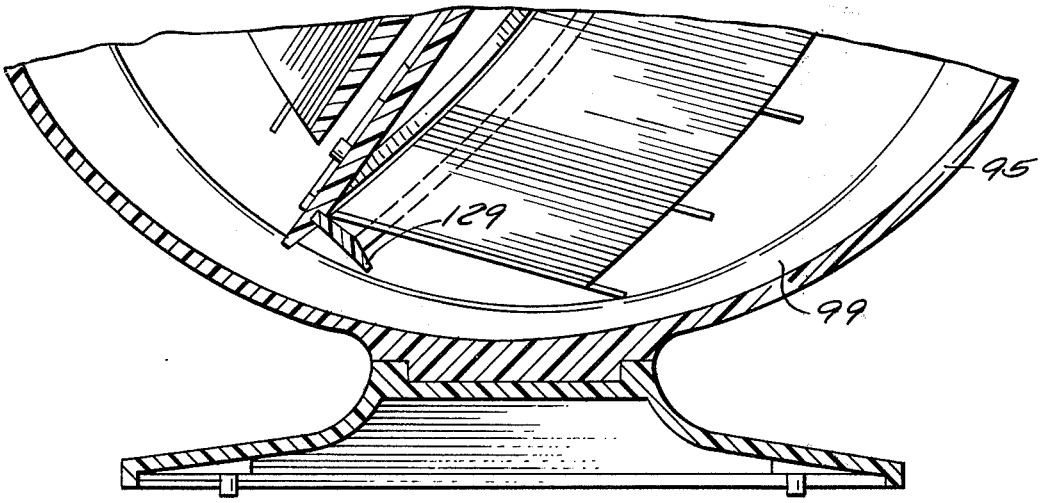

ROTARY FILE

This application is a continuation-in-part of our copending allowed application Ser. No. 467,902, filed May 8, 1974, now abandoned which in turn was a continuation-in-part of application Ser. No. 316,497, filed Dec. 19, 1972.

This invention relates to files for alphabetically arranged cards having delineated thereon such information as names, addresses and telephone numbers. In a more specific sense, this invention is concerned with card files of the rotary type like that of the Karper U.S. Pat. No. 3,734,587.

Hence, in the present invention as in the Karper patent, the cards to be filed are received in and readily removably held in trays which, in turn, are detachably mounted on the radiating arms of a spider-like rotor. The rotor is mounted in a housing for rotation about a horizontal axis so that any selected tray of cards can be brought to a detent-defined viewing station or position with the tray in a horizontal attitude providing for the most advantageous viewing of and access to all of the cards on that tray.

While this invention utilizes the general principles of the Karper card file, it embodies those principles in a significantly improved form, with the result that the card file of this invention is not only more attractive but also more convenient to use.

Broadly stated, the invention resides in an improved card file wherein the cards are carried by a rotor that is mounted in a housing for rotation about a horizontal axis wherein the rotor has a plurality of tray-carrying arms that project substantially radially from the rotor axis so that, upon rotation of the rotor, the arms point downwardly as they traverse the lower part of their orbit; wherein each arm has a card carrying tray removably mounted thereon, the trays having front edges; wherein cooperating guide means on the arms and the trays freely slidably connect the trays with the arms and constrain relative movement between the trays and thr rotor arms to linear motion along the arms to and from a position fully engaged with the arms, in which positions the front edges of the trays are their radially outermost extremities and travel in a circular orbit substantially concentric with the rotor axis as the rotor is turned; and wherein inwardly facing tracks in the lower portion of the housing are so spaced from the rotor axis that the front edges of the trays ride on the tracks as the trays traverse that part of their orbit spanned by the tracks, whereby the tracks hold the trays against outward displacement from the rotor arms on which they are mounted.

In addition to the foregoing, the invention also contemplates an improved design for the component parts of the card file, and a manner of assembling those parts which enables them to be inexpensively produced as injection-molded plastic moldings that are assembled without the need for screws, bolts, rivets or other fastening means.

In this connection, an especially important feature of the invention resides in the fact that its detent-type rotor positioning means is engageable with very little increase in torque as the rotor is turned to bring a selected card tray to the viewing station, the slight increase in effort to effect that engagement being precisely the same for either direction of rotation of the rotor and for all trays.

An aspect of the detent-type rotor positioning means for the invention is that — without modification thereof — it lends itself readily to adaptation to card files having different numbers of tray-carrying rotor arms, as may be required to accommodate cards of different sizes.

Another feature of the invention is the provision of a card-follower for each tray that has an over-center pivotal connection with the tray — at any location along the lengths thereof — and by which the card-follower is resiliently held either in a rearwardly inclined position maintaining the cards in neatly stacked condition to facilitate rotation of the rotor in either direction, or in a forwardly flipped position to support the cards held by the tray while the same is at the viewing station, to thus make it easier to thumb through the stack in search of a particular card.

Still another advantageous feature of the invention resides in the provision of interengageable male and female dovetails on the sides of the card trays by which the trays, upon removal from the rotor, can be connected into a rigid desk-top unit enabling access to and examination of any one of the many cards held by the file.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate several complete examples of embodiments of the invention constructed according to the best modes so far devised for the practical application of the principles thereof, and in which.

Figure 1:
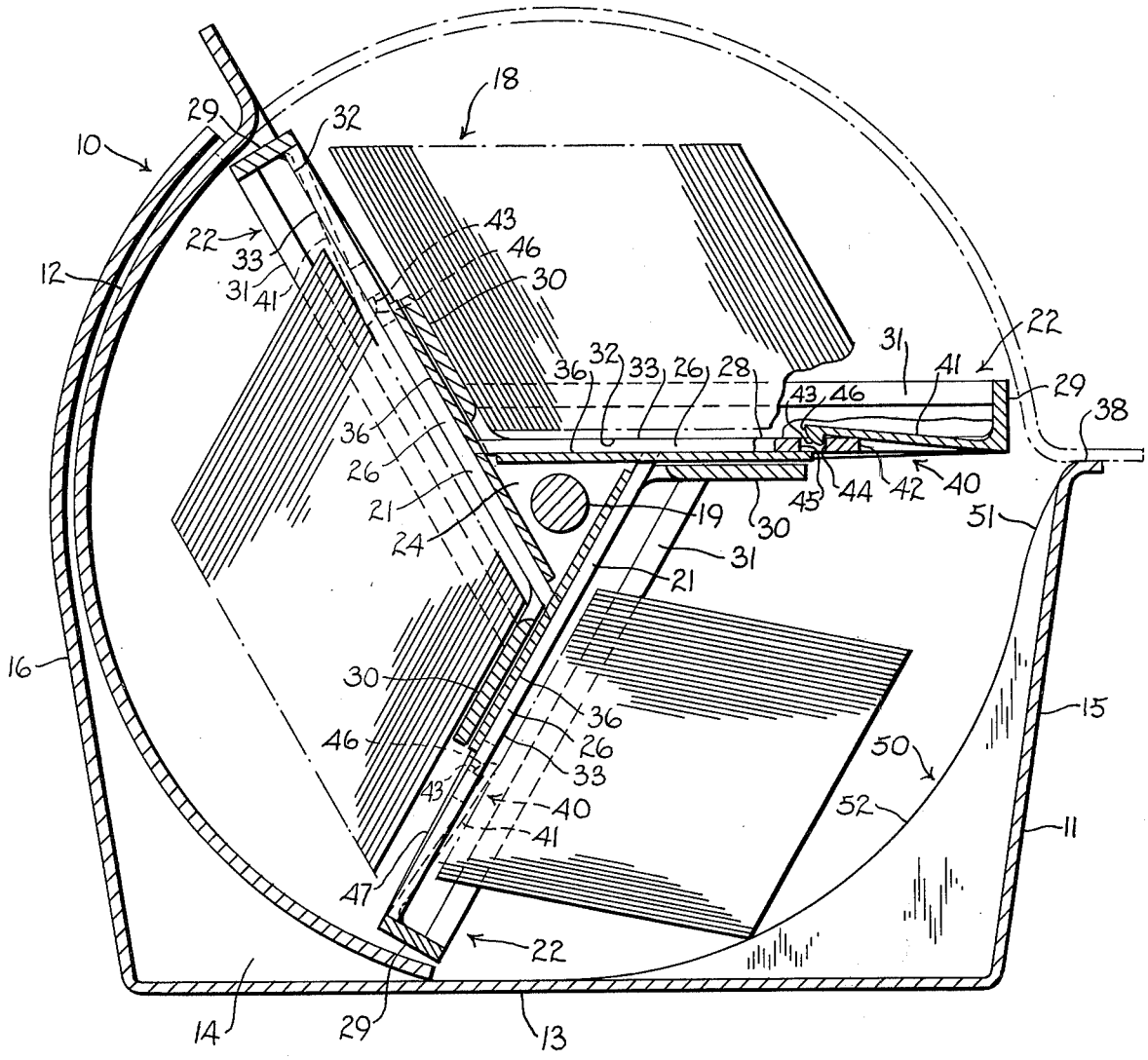
FIG. 1 is a sectional view through a rotary card file constructed in accordance with one embodiment of this invention, with its cover open.
Figure 5:
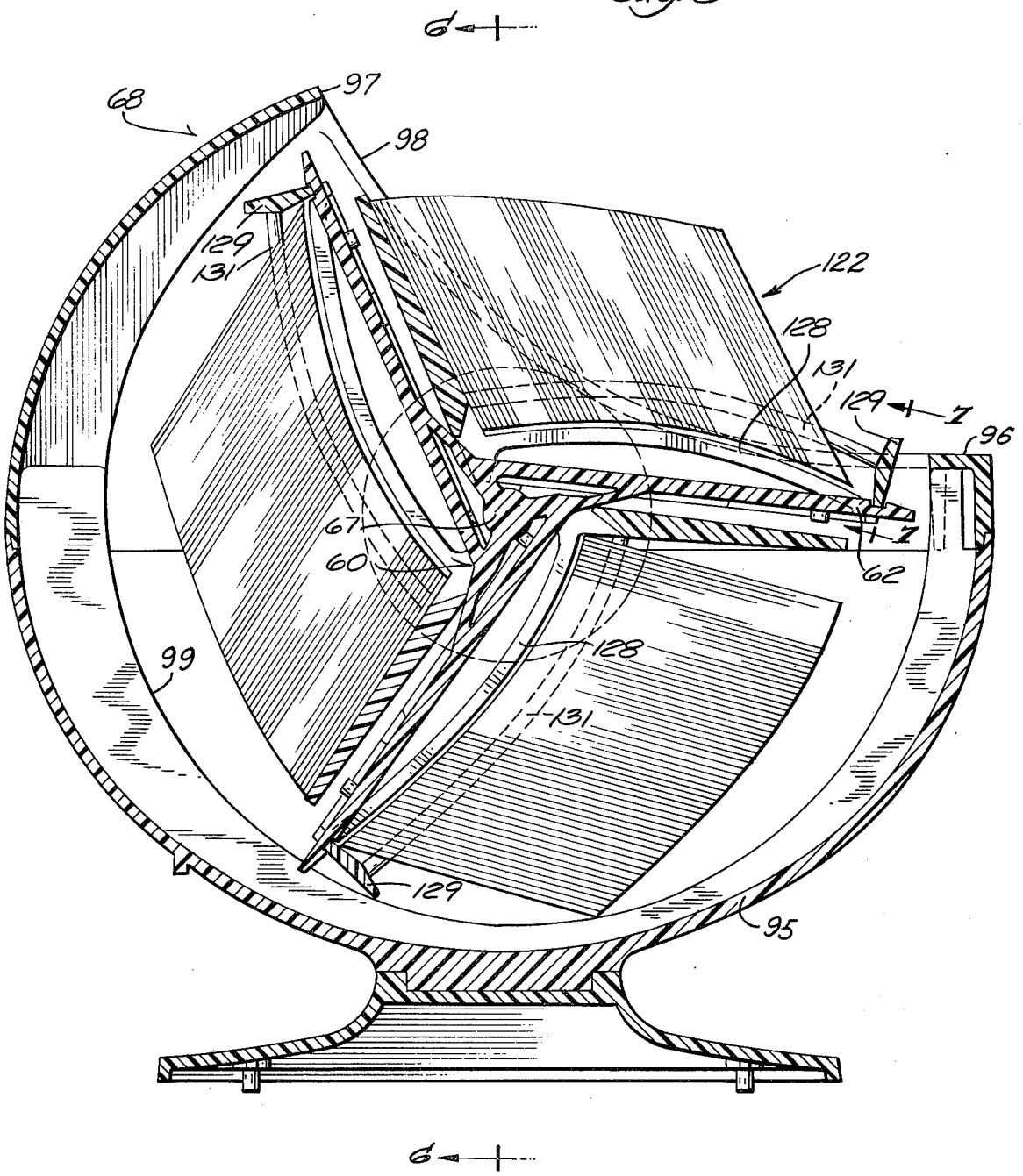
FIG. 5 is a view similar to FIG. 1 but showing a second embodiment of the invention.
Figure 6:
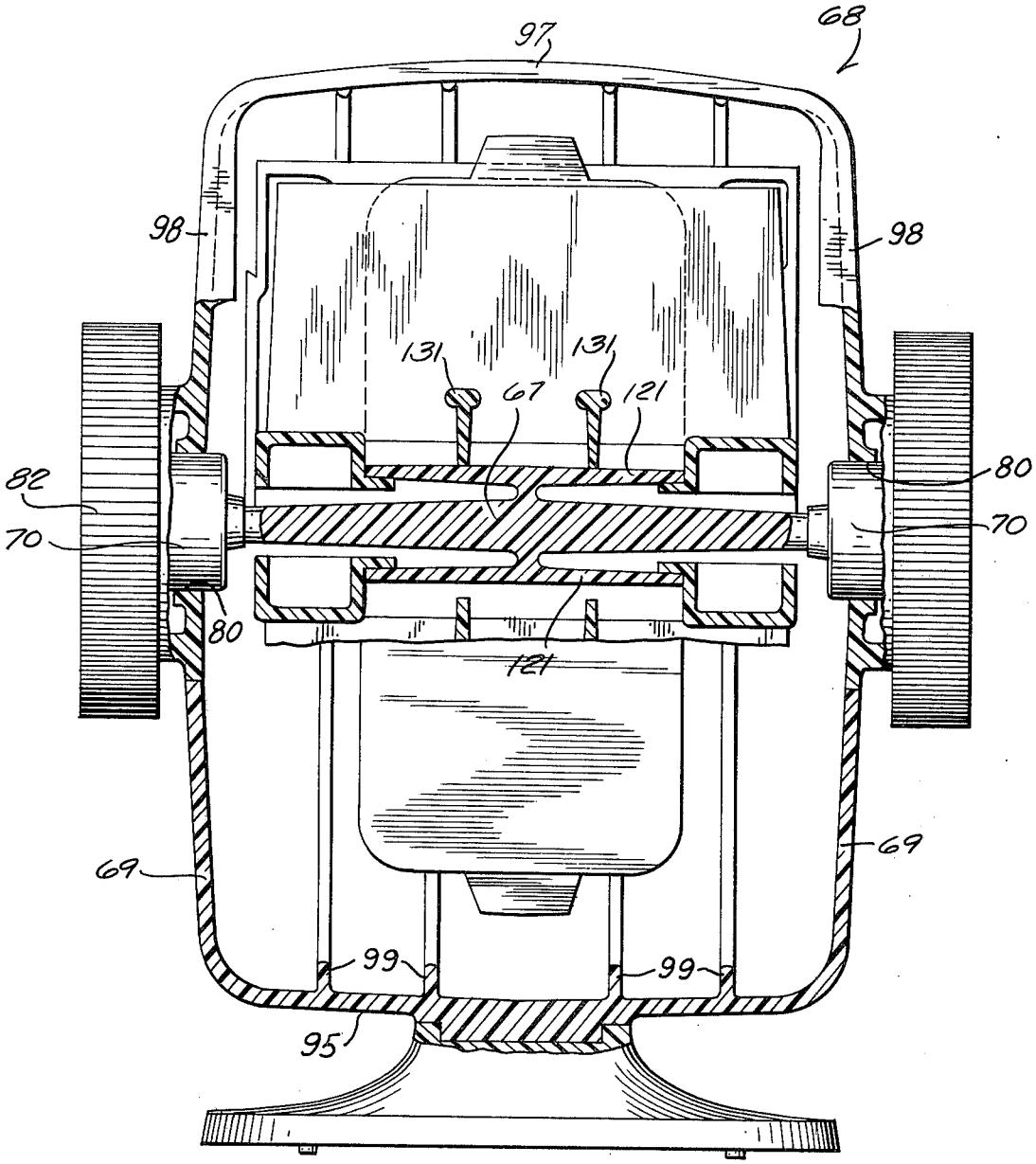
Figure 7:
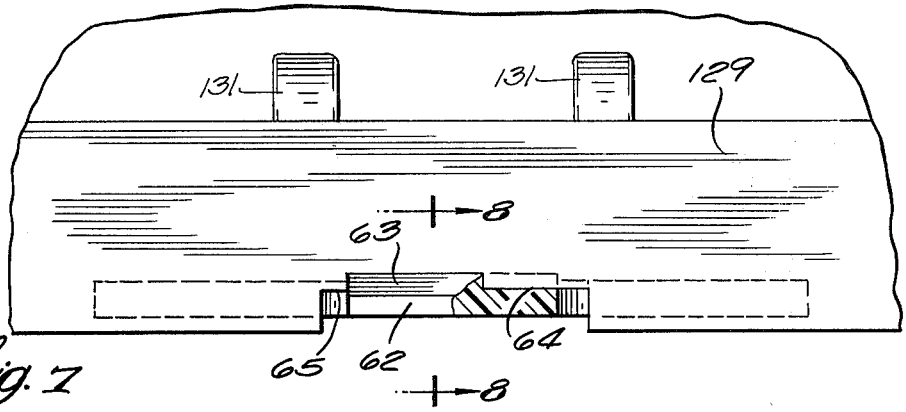
Figure 8:
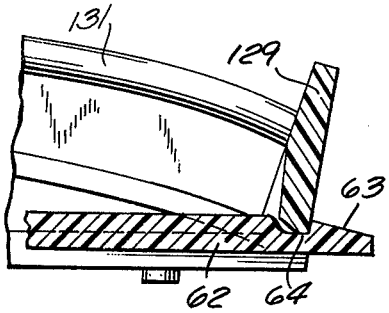
Figure 11:
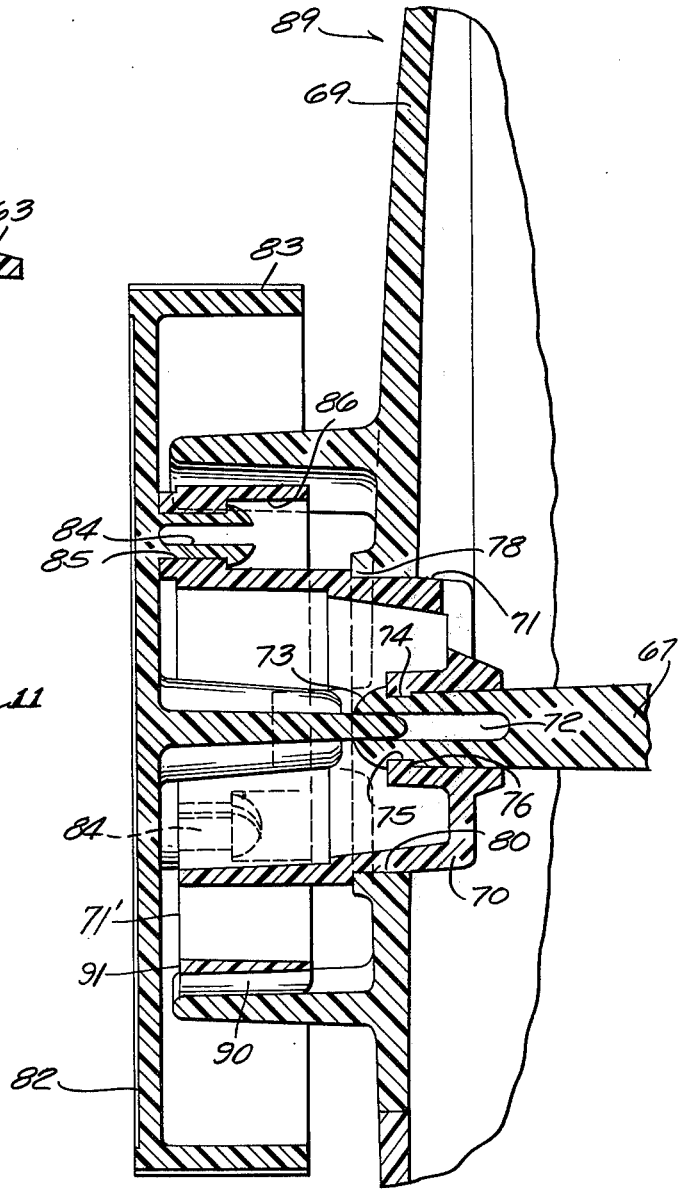
Figure 9:
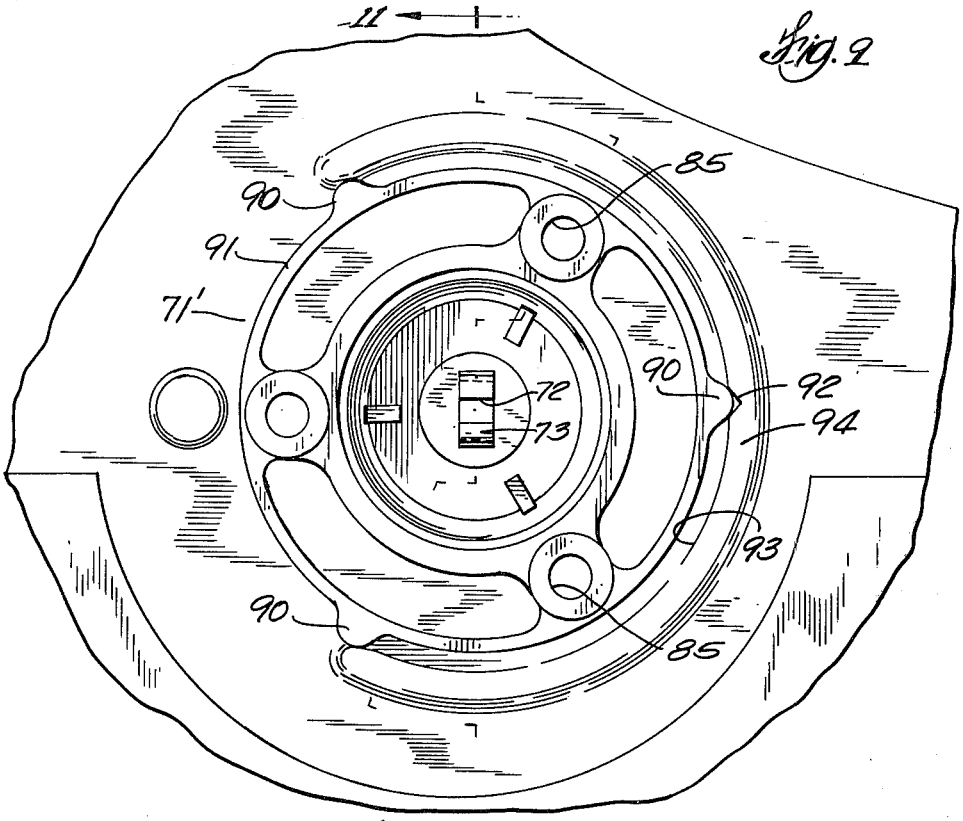
Figure 10:
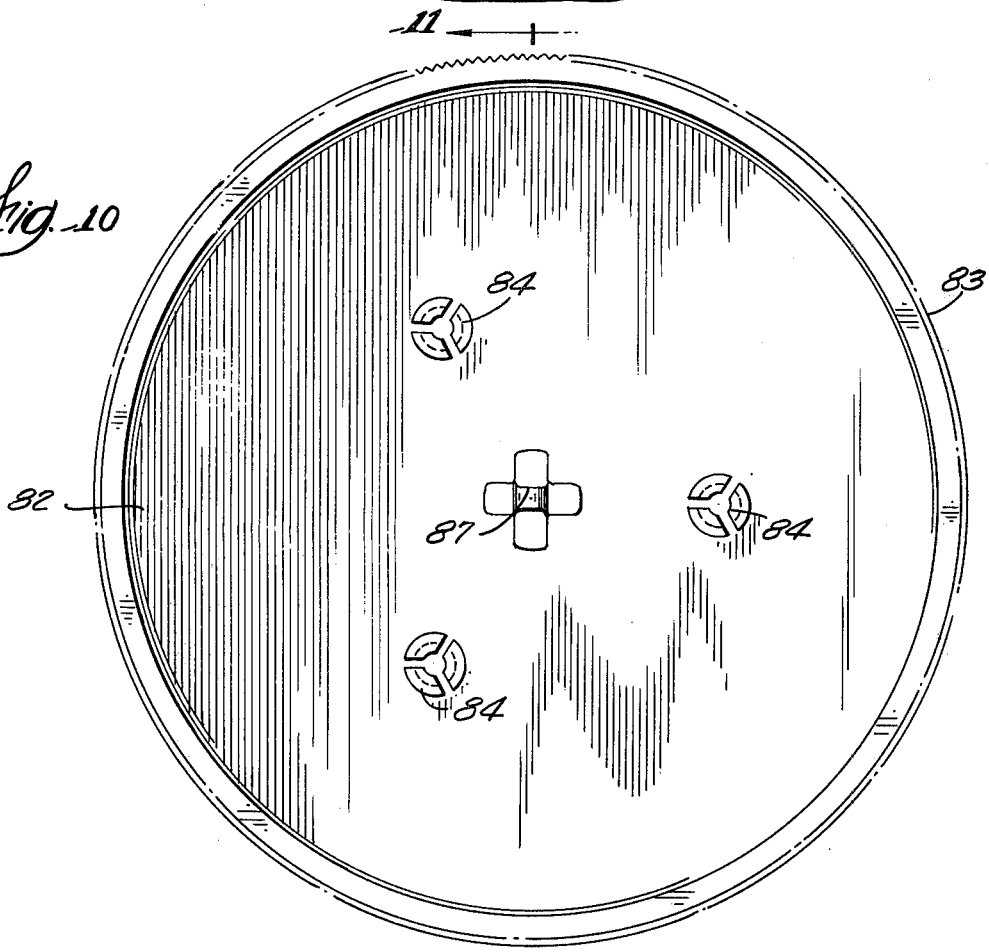
Figure 12:
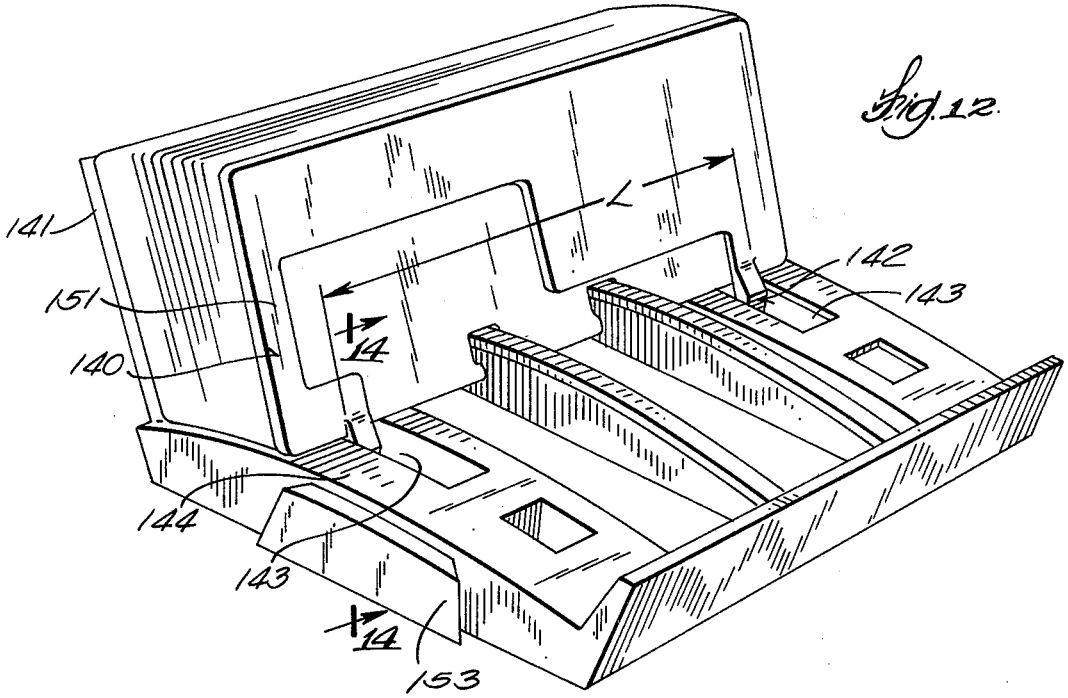
Figure 13:
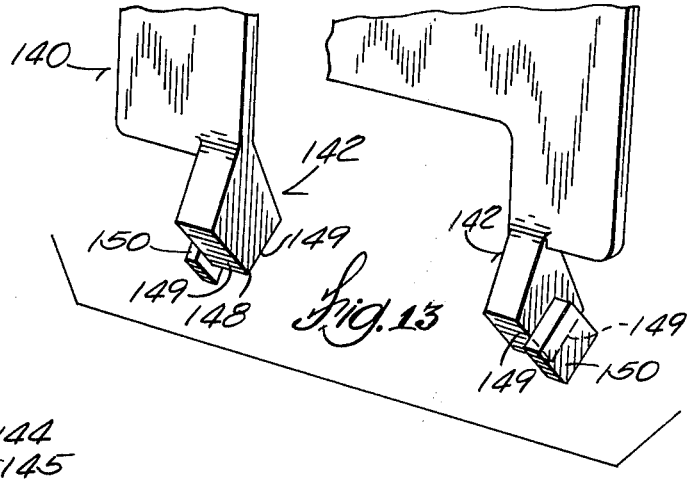
Figure 14:
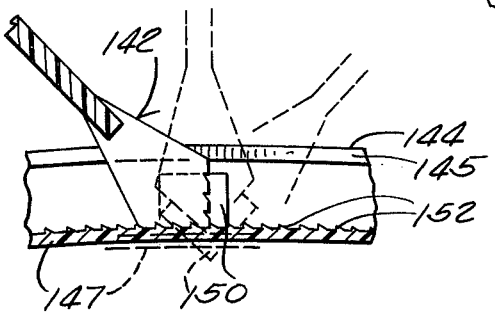
Figure 15:
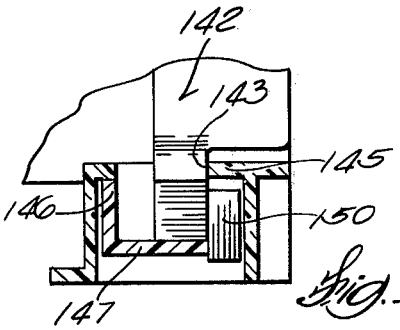
Figure 18:
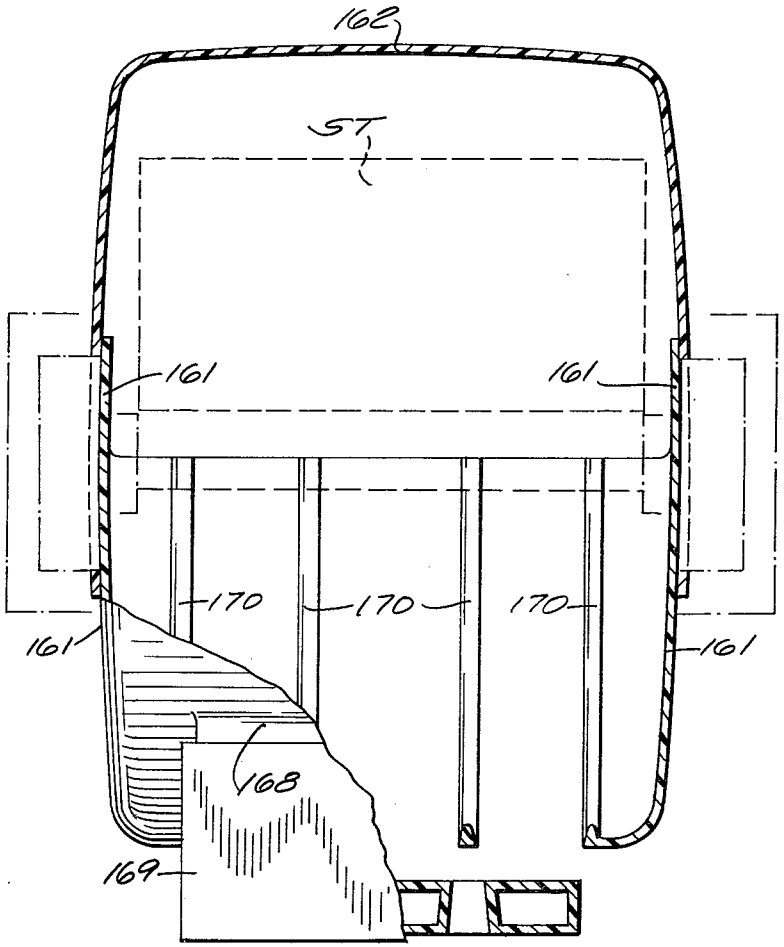
Figure 17:
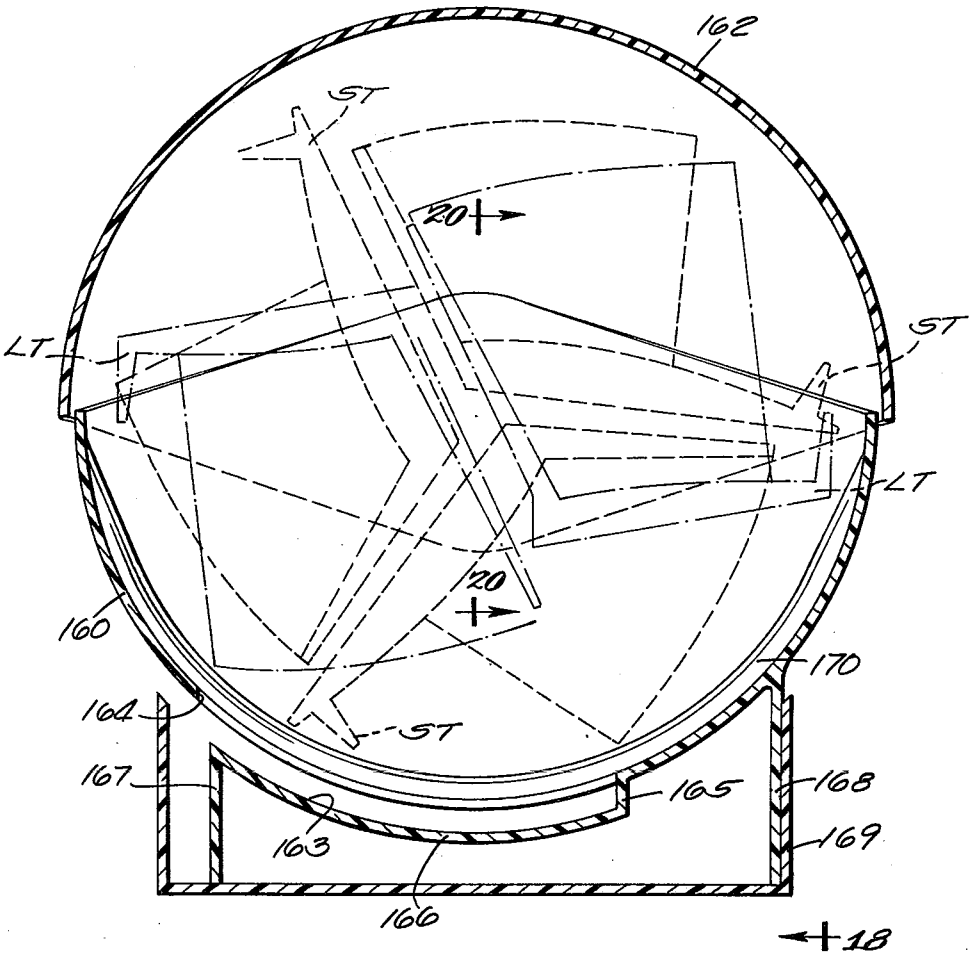
Figure 19:
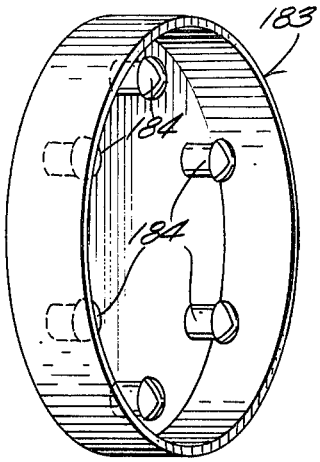
Figure 20:
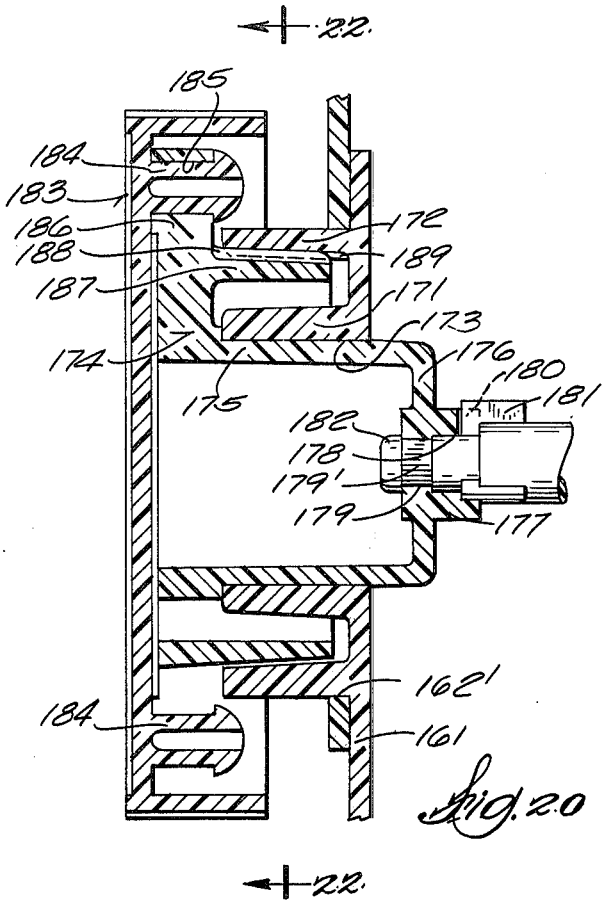
Figure 22:
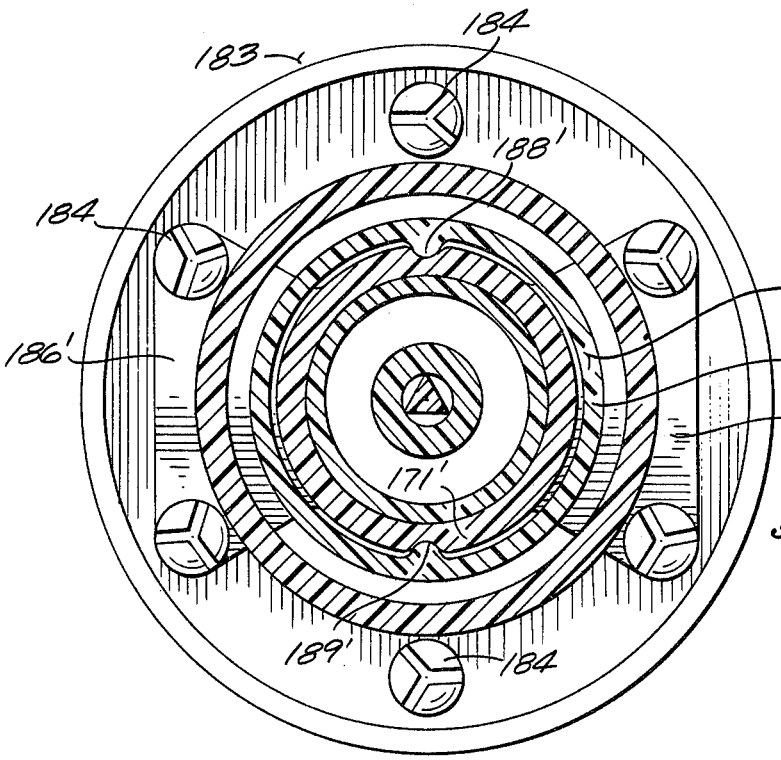
Figure 21:
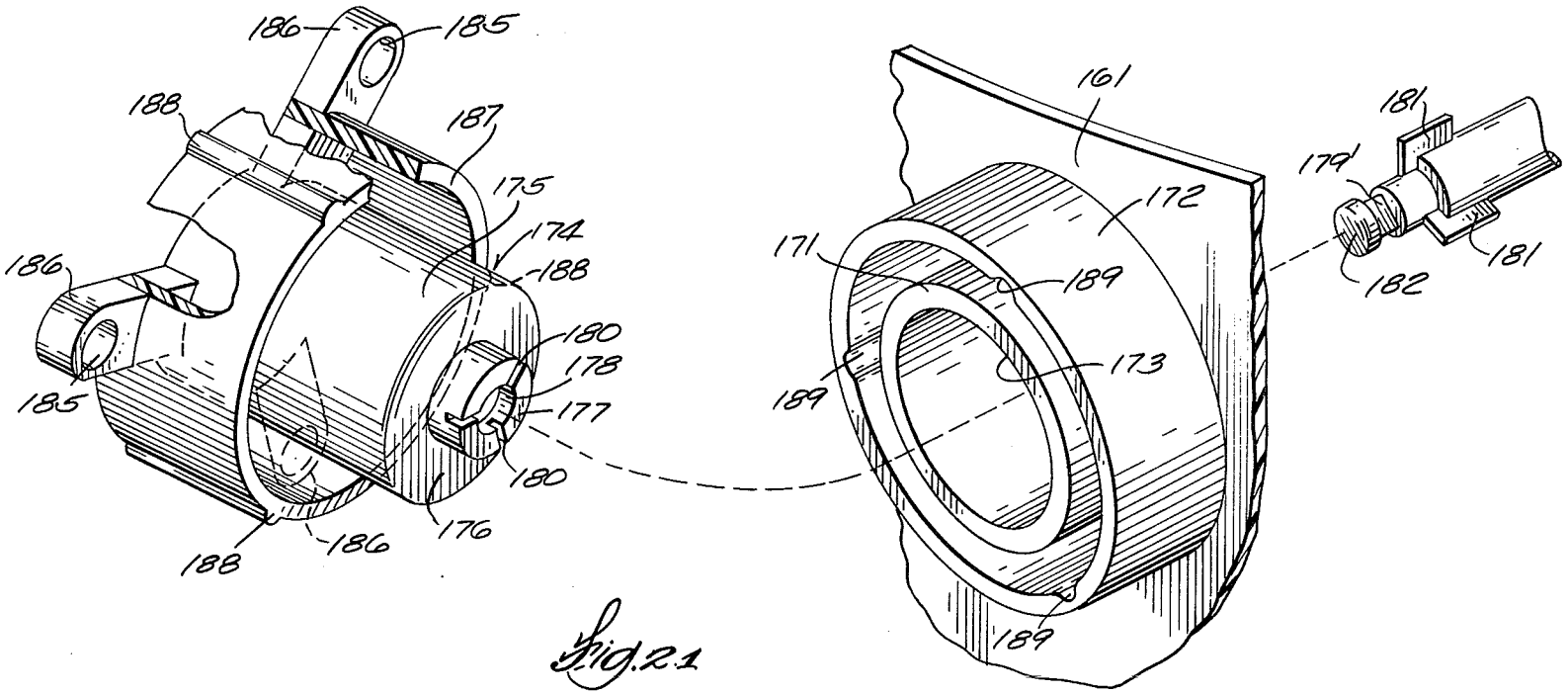

FIG. 5*a*, on sheet 9 is a view similar to the lower portion of FIG. 5, showing a slightly different use of the illustrated structure;

FIG. 6 is a sectional view taken on the plane of the line 6—6 in FIG. 5;

FIG. 7 is fragmentary detail view at an enlarged scale, illustrating front portion of one of the card carrying trays of the card file shown in FIG. 5;

FIG. 8 is a sectional view taken on the plane of the line 8—8 of FIG. 7;

FIG. 9 (on sheet 7) is an enlarged fragmentary side elevational view of a portion of the card file shown in FIG. 5, illustrating the detent means by which the rotor is readily releasably held in any selected viewing position;

FIG. 10 (on sheet 6) is a view of the underside of one of the actuating knobs by which the tray carrying rotor can be turned on its axis to bring different trays to the viewing station;

FIG. 11 (on sheet 6) is a sectional view taken on the plane of the line 11—11 of FIG. 9;

FIG. 12 is a perspective view of one of the card trays of that embodiment of the invention illustrated in FIG. 5, but equipped with an improved follower so connected with the tray that it can be releasably held in either a forwardly or rearwardly inclined position;

FIG. 13 is a fragmentary perspective view of the tray engaging portions of the follower;

FIG. 14 is a detail sectional view through FIG. 12 on the plane of the line 14—14;

FIG. 15 is a cross sectional view through FIG. 14 on the plane of the line 15—15;

FIG. 16 is a bottom view of the card tray;

FIG. 17 is a vertical sectional view similar to FIGS. 1 and 5, illustrating an embodiment of the invention that is adapted to accommodate two different sized cards in a single case or housing, the outline of the trays and cards of the two sizes being indicated in broken lines;

FIG. 18 is a front view of the card file shown in FIG. 17 with parts thereof broken away and in section, with only the profile outline of the rotor for the smaller size cards indicated in light broken lines;

FIG. 19 is a perspective view of one of the rotor turning knobs for the card file of FIGS. 17 and 18, showing the same from its inner side;

FIG. 20 is a sectional view through a portion of one side of the card file shown in FIGS. 17 and 18 taken on the plane of the line 20—20 in FIG. 17, with the structure there shown adapted to the smaller sized cards;

FIG. 21 is an exploded perspective view of the parts at the side of the card file illustrated in FIG. 20; and FIG. 22, on sheet 9, is a cross sectional view through FIG. 20 on the plane of the line 22—22 but showing the adaptation of the illustrated structure to larger sized cards.

THE EMBODIMENT OF THE INVENTION ILLUSTRATED IN FIGS. 1–4

Referring now more particularly to FIGS. 1 through 4 of the accompanying drawings, the numeral 10 generally designates the housing for a rotary card file of this invention. The housing, which is more or less conventional, comprises a base section 11 and a cover 12, shown in its open position in solid lines in FIG. 1 and in the closed position in broken lines. The base section has a substantially deep cup-like shape with a bottom wall 13, and rising from the edges thereof, flat opposite side walls 14, a short front wall 15 and a taller back wall 16.

The file includes a rotary assembly generally designated 18. This assembly has an axle shaft 19 which extends horizontally across the upper portion of the base section 11 with its opposite end portions journalled in the side walls 14 at a location intermediate the front and rear walls of the housing. Knobs 20 fixed to the opposite ends of the shaft at the exterior of the housing facilitate manual manipulation of the rotor assembly.

In addition to the axle shaft 19 the rotor assembly has three circumferentially equispaced identically shaped flat arms 21 generally radiating from the axle shaft, and a card carrying tray generally designated 22 detachably mounted on each of the arms.

As best seen in FIG. 1, on the medial portion of the axle shaft there is a hub 24 which is triangular in cross section. Each of the three sides of this hub has the underside of one of the arms 21 flatwise fixed thereto with the inner end of the arm in abutting engagement with the underside of an adjacent arm. Hence, the inner end portions of the arms, namely those portions thereof which are mounted on the hub, extend across the rotor axis from one side thereof to the other.

Figure 2:
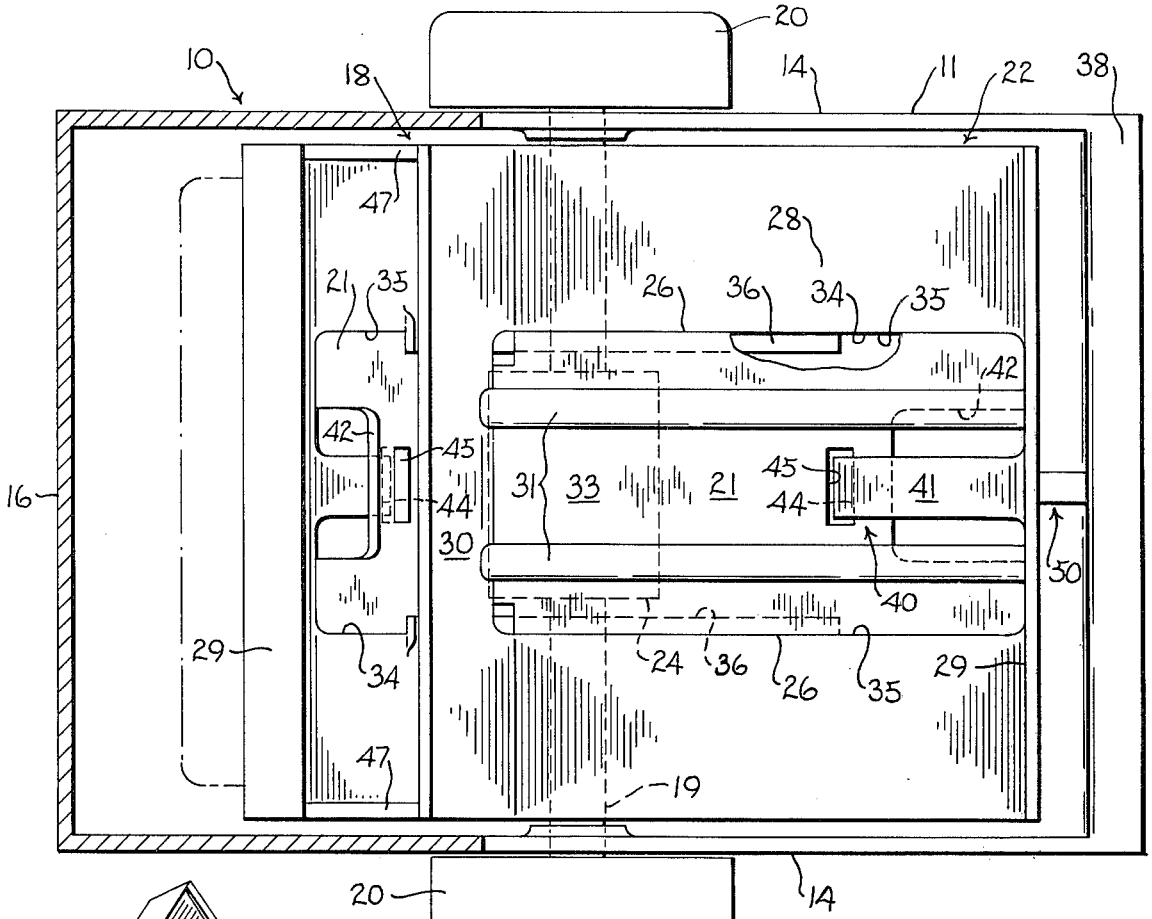
FIG. 2 is a top view of the card file shown in FIG. 1.
Figure 4:
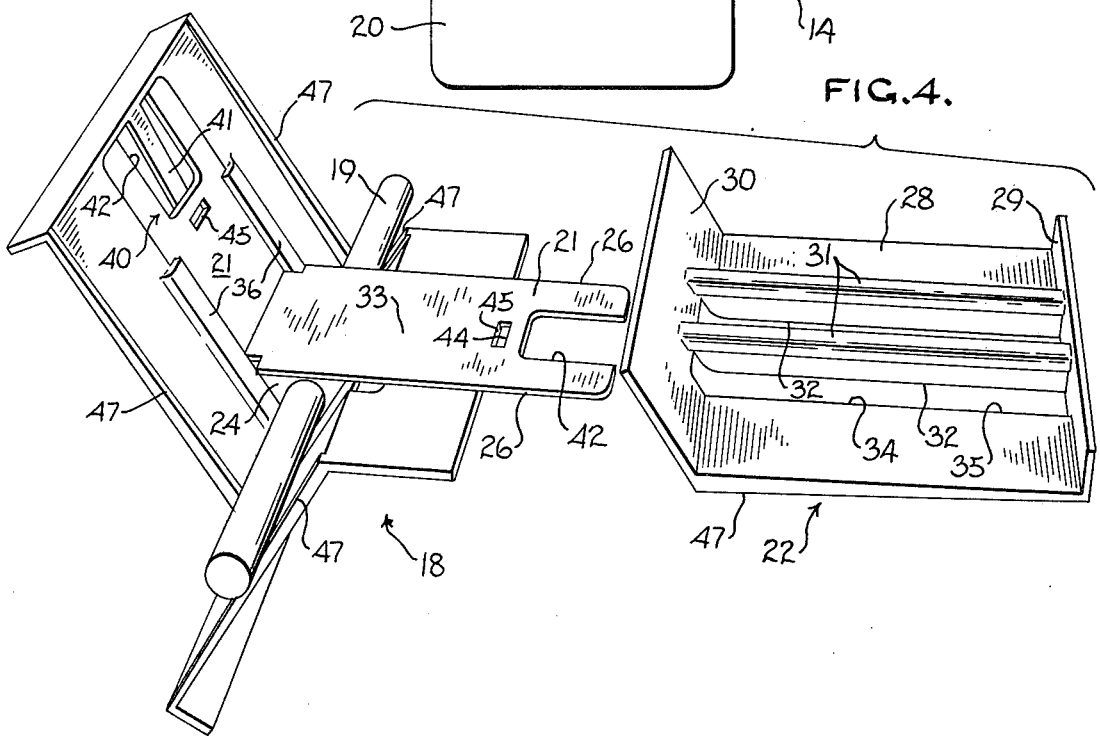
FIG. 4 (on sheet 2) is a persepective view of the rotor assembly of that embodiment of the invention shown in FIG. 1, with one of the card carrying trays shown in a detached position.
Figure 3:
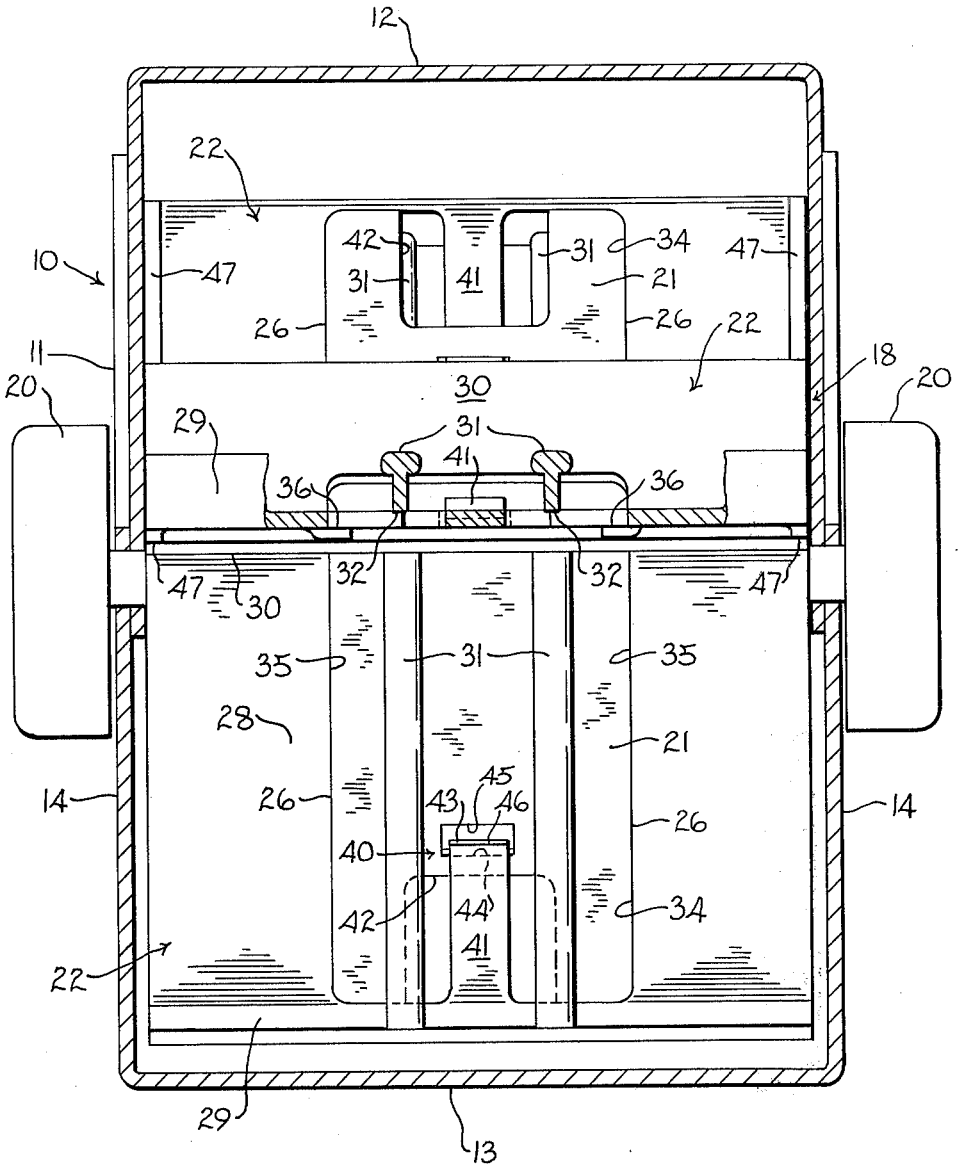
FIG. 3 is a front view of the file, with portions thereof broken away and shown in section.

The hub 24 need not be solid but may, if desired, be provided by a pair of axially spaced triangular plates on the axle shaft, located equal distances inwardly from the opposite side edges 26 of the arms. As best illustrated in FIG. 2 the arms 21 are axially centered on the axle shaft and have parallel side edges 26 which are normal to the rotor axis and are spaced equal distances inwardly from the side walls 14 of the housing.

Each of the trays is substantially wider than the arm carrying it, and comprises a body having a substantially flat bottom 28 which is rectangular in outline, and front and rear flanges 29 and 30 respectively. The flanges extend upwardly along those edges of the bottom 28 which are parallel to the rotor axis. While the front flange 29 is substantially short and perpendicular to the bottom of the tray, the rear flange 30 is taller and inclined rearwardly at an obtuse angle to provide better support for the file cards carried by the tray. When the trays are in position on the rotor, the rear flange 30 of each tray is in close parallel juxtaposition to an adjacent rotor arm 21.

A pair of parallel rails 31 on each tray, above the bottom thereof, detachably holds a pack of file cards on the tray and provides guides along which the cards can slide in the fore and aft direction. The opposite ends of the rails are joined to the flanges 29 and 30, and their upper edge portions are widened to coact, in a conventional manner, with T-shaped slots in the file cards to detachably hold the cards in place.

The bottom 28 of each tray is cut out from front to back as at 34, to slidingly accommodate the associated arm 21. The width of this cutout is slightly greater than that of the arm so that the partallel side edges 35 of the cutout are slidingly contiguous to the opposite side edges 26 of its arm. This positional relationship plus the fact that the lower edges 32 of the rails (FIG. 3) rest upon the upper face 33 of the rotor arms and the engagement of elongated flanges 36 that extend inwardly from the side edges 35 of the arms to slidingly engage the underside of the trays, constrains the trays to substantially radial sliding movement with respect to the rotor towards and from the rotor axis. The limit of inward radial movement of the trays on their respective rotor arms and hence the operative storage position thereof, is defined by the engagement of the medial portion of the front flanges 29 of the trays, (which defines the outer boundary of the cutout 34) with the outer ends of the arms.

This readily detachable connection between the trays and their respective rotor arms allows the trays to be slid outwardly off of their arms when the rotor has been turned to bring the selected tray to a viewing station at which the bottom of that tray is substantially horizontal and in position to clear the lip 38 that forms the upper edge of the front wall 15 on the base section of the housing.

In that embodiment of the invention illustrated in FIGS. 1–4, each tray is normally held against displacement out of its operative storage position on the rotor by means of a latch device 40. This latch device comprises a resilient tongue or latch lever 41 having one end fixed to the front portion of the tray, and its other end portion projecting rearwardly into the cutout portion 34 of the tray and into a notch 42 in the forward end of the associated arm 21. A hook 43 on the rear end portion of the latch lever 41 is engageable behind a keeper 44 formed as one edge of a hole 45 in the associated arm spaced a short distance rearwardly of the bottom of the notch 42 therein, to latch the tray to its arm.

The latches 40 are automatically engageable when the trays are slid inwardly to fully assembled storage or normal operative positions on their respective rotor arms. At such times, the latches will snap into latching position behind the keepers after being cammed upwardly by the engagement of the bottoms of the notches 42 with inclined surfaces 46 on the hooked ends of the levers. The levers, of course, can be released from their keepers by the finger of an operator pressing upwardly on the levers through the notches 42 in the rotor arms.

It will be appreciated that the detachability of the trays from the rotor arms has the advantage of enabling the trays to be removed from the card file and place on a table top or other work surface to facilitate removal of individual file cards from the trays, placement of cards into the tray and/or rearrangement of the cards.

In order to assure stability of the trays when they are placed on such a work station, they are formed with ribs 47 which extend fore and aft along the side edges of the trays at their bottoms. The ribs are tapered to a greater dimension at the rear of the trays so as to tilt the same upwardly and forwardly and thus facilitate viewing of file cards thereon; and their bottom edges define seating surfaces which lie in common planes representing the lowermost portions of the trays.

In the event a person working on the file cards should fail to fully return a detached tray to its latched positions, means is provided to assure inward movement of such a tray to its fully assembled position on the rotor as the latter is rotated (clockwise as viewed in FIG. 1) to bring the next tray to the viewing station.

The means for effecting this important objective comprises one or more fin-like cams 50 on the front wall 15 of the base section of the housing. Each such cam extends toward the rotor axis from the inner surface of the front wall 15, and its camming surface 51, which starts at the upper edge of the front wall, angles downwardly and rearwardly to become tangent to a curved surface 52 on the cam which is concentric to the rotor axis and corresponds to the orbit of the outermost portions of the trays in their fully latched positions. Accordingly, a tray not fully returned to its proper storage position on the rotor will have its front edge collide with the camming surface 51 as the rotor is turned and — by that engagement — the tray will be pushed home.

THE EMBODIMENT OF THE INVENTION ILLUSTRATED IN FIGS. 5–11

FIGS. 5 through 11 illustrate a second embodiment of this invention. Here again, the rotor — identified by the numeral 60 — has three angularly equispaced flat arms 121 upon which card carrying trays 122 are detachably mounted with the back 123 of each tray in close juxtaposition to the underside of an adjacent arm.

The rotor 60 comprises three component parts — namely, an axle 67 which extends across the interior of the housing 68 between the upright side walls 60 thereof and has the arms 121 radiating therefrom, axle support members 70 and connecting means by which the axle support members are secured to the ends of the axle in rotation transmitting relation thereto.

The axle support members 70 have hub portions 71 that project axially from larger head portions 71'. Upon securement of the axle support members to the opposite end portions of the axle, the hub portions are seated in axially aligned bearing forming holes 80 in the housing side walls and thus rotatably mount the rotor in the housing. The axle support members are secured to the ends of the axle by snap-on connections illustrated in FIG. 11. These connections comprise bifurcated end portions 72 on the axle that are inserted into sockets formed in the hub portion of the axle support members. To prevent relative rotation between the axle support members and the axle, the bifurcated end portions of the axle have flat sides 74 that intimately engage mating flat surfaces in the sockets, and to secure the axle support members against detachment from the axle, there are heads 73 on the outer extremities of the axle that coact with facing abutments 76 to confine a portion 75 of the axle support members therebetween. With the axle support members attached to the axle, inwardly facing annular shoulders 78 on the former engage the outer surfaces of the housing side walls 69 and thus hold the rotor against axial displacement.

A knob or dial 82 connected to the head portion 71' of each of the axle support members facilitates manual rotation of the rotor necessary to bring each tray thereon to the viewing station. Each such knob has an externally knurled rim portion 83 which encircles the adjacent axle support member, and a number of barbed and bifurcated prongs 84 which project from the underside of the knob and into holes 85 in the head portion of the axle support members. The barbed ends of the prongs engage the bottoms counterbores 86 to which the holes 85 open to prevent outward displacement of the knobs from their axle support members.

A substantially flat stem 87 on each knob also projects from its underside to be received in the cross slot in the adjacent bifurcated end portion of the axle. Hence, the stems 87 cooperate with the prongs 84 in the establishment of driving connections between the knobs and the axle support members 70.

The viewing position of each of the card carrying trays is defined by a detent mechanism which will now be described. This detent mechanism comprises three angularly equispaced ridges 90 formed on the periphery of an annular outer rim 91 which forms part of the head portion 71' of each axle support member 70, there being one ridge for each tray, and a notch 92 formed in the inner surface 93 of an arcuate flange 94 fixed on the exterior of each housing side wall, in radially outwardly spaced cencentric relation to said rim portion 91.

The ridges 90 track upon the inner surface 93 of the flange 94 as the axle support members are rotated. Since the ridges travel in orbit slightly greater in diameter than that of the inner surface of said flange, those portions of the annular rim portion 91 adjoining the ridges are caused to flex inwardly. As a result, the restoring forces in said inwardly flexed rim portions cause the ridges to be in turn snapped into the notch 92 to arrest rotary motion of the knob and the axle support member at the various angular positions of rotor rotation at each of which one of the trays is in the viewing position.

It should also be observed that the arcuate length of the flanges 94 is great enough to assure engagement therewith at all times of at least two of the ridges 90 on each axle support member. This produces a light but desirable drag on the rotor, by which it can be temporarily held in angular positions other than those corresponding to the viewing positions of the card carrying trays. One advantage of this brake action or drag upon the rotor is that — because of it — the rotor can be held in the most convenient position for detachment of the card carrying trays therefrom. Such detachment of the trays, of course, is usually effected when the tray to be removed is in a position displaced slightly in the counterclockwise direction from its viewing position.

As will be apparent from FIGS. 5 and 6, the side walls 69 of the housing 68 are connected by a continuous curved wall 95 which extends through somewhat less than 270° and provides what might be termed the front, rear and bottom of the housing. Since this curved wall extends through less than 270° it has an edge 96 which is at substantially the level of the rotor axis and defines the top of the front wall and an edge 97 which defines the top extremity of the rear wall of the housing. Together with the edges 98 of the side walls, the edges 96 and 97 form the boundary of an upwardly and forwardly facing opening through which access is had to the card carrying trays as they are brought — by rotation of the rotor — to a viewing position. A tray in that viewing position is substantially horizontally oriented with its front flange 129 in juxtaposition to the top edge 96 of the housing front wall. As noted hereinbefore, removal and replacement of a tray is most easily effected with the rotor in a position at which the tray is slightly above its viewing position.

In that embodiment of the invention illustrated in FIGS. 1–4, the trays have to be latched to their respective rotor arms to preclude undesirable outward shifting of the trays as they traverse at least 90° of their orbit that lies clockwise beyond its bottommost point, as viewed in FIG. 1. It is for that reason that the fin-like cams 50 have the inclined camming surface 51 to push the trays to their latched positions in the event they were not brought to that position during their replacement onto their respective rotor arms.

In the embodiment of the invention particularly illustrated in FIGS. 5 and 6, the trays do not have to be latched to the rotor arms to prevent their displacement as they are carried along the bottom part of their orbit. Assurance against that happening is provided by a series of laterally spaced fins or ribs 99 that extend for the full arcuate length of the curved housing wall 95. The edges of these fins or ribs form curved track means along which the radially outermost edges of the trays slide as the rotor is turned. Since the distance this curved track means is spaced from the rotor axis is far less than that required for a tray to be slid off of its respective rotor arm, it follows that the track means holds the trays against displacement from their respective rotor arms as the arms traverse the lower part of their circular orbit.

Accordingly, in that embodiment of the invention shown in FIGS. 5 etc., latches are not needed, except to provide assurance against having the trays slide off of their respective arms if, during handling of the device, it is turned upside-down. For that purpose latches 62 are provided. They consist of a lip 63 that projects from the outer edge of each of the rotor arms 121 and has an inclined top surface leading to a notch into which the bottom edge of the front flange 129 of the tray snaps as the tray is slid all the way home on the rotor arm.

To disengage the latch and free a tray for removal from a rotor arm, it is only necessary to depress the arm by applying downward pressure on its lip 63.

The curved track means formed by the edges of the fins or ribs 99, in addition to holding the trays against displacement from the rotor arms as they traverse the lower portion of their circular orbit during rotation of the rotor, also provide smooth rails along which the edges of the bottommost one of each stack of cards slides during rotation of the rotor; and, to assure continuity of these rails despite the fact that the housing is molded in two parts that are joined together in superimposed relation, the locations of the fins 99 of the two housing sections are staggered so that the fins in one section overlap those of the other section in close juxtaposition.

Where the cards carried by the different trays are arranged in groups separated from one another by dividers with indicator tabs thereon — as illustrated in FIG. *5a*— it is the radially outermost of these tabs that ride on the rails provided by the fins or ribs 99; and, since the tabs on the dividers are positioned at different locations across the width of the dividers, there are several fins or ribs spaced laterally from one another, as shown in FIG. 6, and so located that each fin or rib is in a position to have a different set of divider tabs riding thereon.

Like the trays in the embodiment of the invention illustrated in FIGS. 1–4, the trays 122 have T-shaped rails 131 to which the cards are removably attached, but in this case these rails are slightly bowed from front to back as are also the bottom portions 128 of the opposite side edges of the trays. This curvature facilitates sliding the file cards fore and aft along the rails with the lower edges of the cards resting on the curved bottom portions 128.

THE IMPROVED CARD FOLLOWER (FIGS. 12–15)

Another advantageous feature of the card file of this invention is illustrated in FIG. 12. As there shown, the trays in which the cards are carried are equipped with a card-follower or retainer 140 that has an over-center pivotal connection with the tray by which the follower can be held in either a rearwardly or a forwardly inclined posture. In the former, shown in full lines in FIG. 12, the card-follower presses the cards on the tray against its rear wall 141 and thus holds them in neatly stacked condition. In its forwardly inclined position (shown in dotted lines) the follower provides a rest for cards flipped forwardly during examination of the tray contents.

Not only does the pivotal over-center connection between the follower 140 and the tray hold the follower in either a rearwardly or a forwardly inclined posture, but it also enables the follower to be moved to any selected location along the length of the tray. To attain these objectives, the connection between the follower and the tray comprises a pair of fingers 142 located at the opposite lower corners of the follower that are received in slots 143 that extend fore and aft through the top wall 144 of the tray. The fingers 142 coact with ledges 145 that project inwardly from the side walls 146 of the tray and define the outer edges of the slots, and with strips 147 that underlie the slots 143 and — by that coaction — hold the follower at a selected location along the length of the slots and also in its selected forwardly or rearwardly inclined posture.

As best seen in FIG. 13, each finger 142 has a fulcrum edge 148 defined by flat right angularly disposed bottom surfaces 149, and a square lug 150 projecting from the outer face of the finger and so located with respect to the bottom surfaces 149 that two sides of the square lug are parallel to and spaced downwardly from those surfaces.

The distance between the laterally outer faces of the fingers, indicated by the dimension line L in FIG. 12, is just slightly less than the distance between the outer edges of the slots 143 so that when the follower is in place on the tray, the square lugs 150 are beneath the ledges 145 and one bottom surface of the fingers has flat surface-to-surface engagement with the strips 147, as shown in FIGS. 14 and 15.

Because of the illustrated dimensional relationship that exists between the sides of the square lugs and the bottom surfaces 149 of the fingers with respect to the spacing between the ledges 145 and the strips 147, rocking of the follower about the fulcrum edges 148 of its fingers from one inclined position to the other entails slightly increasing the spacing between the ledges and the strips. To permit such displacement, the strips 147 have a degree of resilience.

As noted above, the distance L between the laterally outer faces of the fingers is only slightly less than the distance between the inner edges of the slots 143, but the square lugs 150 project beyond the outer faces of the fingers. Assembly of the follower with the tray thus requires that the fingers be deflected inwardly from their normal positions. To enable that to be done, at least one of the fingers 142 is connected to the follower by a narrow arm 151 that has sufficient edgewise resilience to permit inward deflection thereof the distance needed to tuck the square lug on that finger under the ledge 145 after the lug on the other finger has been engaged under the opposite ledge.

The resilient strips 147 can be integral with the tray or they may be separate parts attached to the tray in any suitable manner. In any event, these strips extend for the full length of the slots 143 so that the follower can be located at any desired distance from the back wall 141 of the tray.

If desired, the resilient strips may be provided with transverse serrations 152, as shown in FIG. 14. Such serrations help in preventing undesired shifting of the follower location.

SIDE-BY-SIDE CONNECTION OF TRAYS FIG. 16

Inasmuch as all of the trays are readily removable from the rotor, they can be arranged side-by-side on a desk top to enable examination of and access to all of their contents, and — to facilitate that mode of using the card file — the trays have male and female dovetails 153 and 154 at their opposite sides, as shown in FIG. 16. By interengagement of these dovetails, any number of trays can be connected into one rigid unit.

As also shown in FIG. 16, each tray has four rubber feet 155 on which it stands when placed on a desk top.

THE EMBODIMENT OF THE INVENTION ILLUSTRATED IN FIGS. 17–22

The embodiment of the invention illustrated in FIGS. 17–22 distinguishes in several respects from the structure previously described — most notably in its adaptability to two different sized cards. As depicted in broken lines in FIG. 17, for the large size of cards — for instance, 3× x 5×— the rotor has only two arms and carries only two card trays, identified by the letters LT; while, for the smaller cards (2.2× x 4×) it has three arms and carries three trays identified by the letters ST. In other respects, the general design of the rotors and trays can follow that illustrated in FIGS. 5 and 6.

Another distinction of this embodiment of the invention, illustrated particularly by FIGS. 17 and 18, resides in the fact that the housing of the card file is so designed that it can be formed as a single molded part, which is not possible with the structure shown in FIGS. 5 and 6. To enable the housing to be made as single molding, its front, rear and bottom are defined by a semi-cylindrical wall 160 which extends through only slightly more than 180° and is joined at its opposite ends to side walls 161, the medial portions of which project above the rotor axis far enough to encompass the structure by which the rotor is connected with the housing and releasably held in different detent-defined positions.

An arcuately shaped cover 162 swings about the axis of the rotor between a closed position fully covering the open top of the housing and an open position exposing the cards for access. The manner in which the cover is connected with the housing will be described later.

At this point, attention is directed to the fact that the housing has an arcuate slot 163 to accommodate the cover as it is swung to its open position. Since the housing — like all the other parts of the card file — is a plastic molding, the slot 163 results from having its semi-cylindrical wall 160 interrupted at 164 and stepped downwardly at 165 to continue as a downwardly offset concentric wall portion 166, to a point in line with the interruption 164 where it joins a vertical wall portion 167. The vertical wall portion 167 and a similar vertical wall portion 168 projecting down from the wall 160, coact to snugly seat the housing in a box-like base 169.

An important observation with respect to the formation of the housing is that track-forming ribs 170 project inwardly from its semi-cylindrical wall 160 and continue uninterruptedly — bridging the slot 163 — from the front edge of the housing to its rear edge. These ribs, like their counterparts in the already described embodiment of the invention, provide a series of parallel spaced apart semi-cylindrical tracks along which the radially outer extremities of the card trays slide as they traverse the lower portion of their orbit upon rotation of the rotor.

As noted hereinbefore, a feature of the embodiment of the invention illustrated in FIGS. 17–22 resides in its capability of handling different sized cards. This difference in card size is depicted in FIG. 17 by the two dotted-line illustrations of the outline of the cards and the trays on which they are carried. Illustration A depicts the smaller card size for which the rotor has three arms, as in the previously described card files; illustration B depicts the large card size for which the rotor has only two tray-carrying arms.

As noted hereinbefore, the structure of the rotor and the card trays detachably mounted thereon is substantially the same as it is in the embodiment of the invention illustrated in FIGS. 5–16, and hence requires no description here.

However, there is a significant difference in the arrangement of the detents by which the rotor is releasably held in selected positions. Bearing in mind that one of the purposes of this embodiment of the invention is to provide a card file in which the same housing accommodates a three-armed rotor and a two-armed rotor, the former for the small sized cards and the latter for the larger cards, it is evident that the previously described detent-forming means shown in FIGS. 9 and 11 cannot be employed without some modification. That modification resides in substituting for the arcuate flange 94 two concentric radially spaced inner and outer circular flanges 171–172, respectively, that project from the outer face of each housing side wall. The inner surface of the smaller diameter flange, in each instance, is flush with the boundary of a hole 173 through the housing side wall and, together therewith, forms a bearing for a hub 174 attached to the adjacent end of the rotor axle. The hubs 174 are the counterparts of the axle support members 70 of the previously described embodiment of the invention, illustrated particularly in FIGS. 6 and 11.

Each hub 174 has a central tubular portion 175 open at one end and partially closed at its other end by a wall 176 from which a smaller diameter boss 177 coaxially projects. This boss has a cylindrical socket 178 that opens to the interior of the central tubular portion 175 through a triangularly-shaped hole 179 in the end wall 176. The cylindrical socket 178 is of a size to snugly receive an end portion 179 of the rotor axle and radial slots 180 in the boss 177 receive fins 181 that radiate from the end portion 179 of the rotor axle upon assembly of the hub with the rotor. A secure torque transmitting connection is thus established between the rotor and the hubs 174 which connection is held against separation by the forced passage of button-like knobs 182 on the ends of the rotor axle through the triangularly-shaped holes 176.

The outer diameter of each hub 174 is of a size to freely rotatably fit the inside diameter of the inner circular flange 171 which — as indicated — is coextensive with the forms a continuation of the hole 173 through the side wall of the housing. Accordingly, upon assembly of the hubs with the rotor axle, the rotor is mounted in the housing for rotation about its axis.

To facilitate imparting such rotation to the rotor, each hub 174 has a dial or knob 183 attached thereto, the attachment being made by the insertion of bifurcated knobed prongs 184 that project from the inner face of the dials or knobs into appropriately located holes 185 in the outer ends of arms 186 that radiate from the hub.

To define the viewing position of the rotor for each of its three card trays, when — as shown in FIGS. 20 and 21 — the card file is being used for the smaller sized cards, at least one and preferably both of the hubs 174 has an encircling coaxial relatively thin walled cylinder 187 joined thereto, but only through the arms 186. The outer diameter of this cylinder is slightly smaller than the inside diameter of the outer one (172) of the concentric flanges so that except for the presence of three equi-circumferentially spaced axially extending ridges 188 projecting from the outer surface of the cylinder 187, the hubs 174 — and hence the rotor — would be freely rotatable.

The presence of the ridges 188 on the outer surface of the cylinder 187 slightly deforms the resilient cylinder 187 which results in a relatively light frictional drag upon rotation of the hubs, until the ridges align with and snap into detent forming axially extending grooves 189 in the inner wall surface of the outer flange 172. Upon such alignment, one of the three detent-defined positions of the rotor is identified, in each of which one of the three card carrying trays is at the viewing station.

To adapt the card file for the larger size cards, the three-armed rotor is replaced by a two-armed rotor and the hubs 174 are replaced by hubs 174'. Except for the fact that in this instance the thin walled cylinder 187' of the hub coacts with the inner one (171) of the concentric flanges, the foregoing description would apply to the two-armed large card size version of the card file. However, in this case, the thin walled cylinder 187' on the hub has its ridges 188' projecting from its inner surface to snap into detent-defining grooves 189' in the outer surface of the smaller (171) of the concentric flanges; and instead of the three equispaced detents, there are only two. Also, as shown in FIG. 22, for the large sized cards the hubs have two, rather than three, arms 186' and each of these arms has two holes 185' to provide for the attachment of the dials or knobs 183. Since there are six equi-circumferentially spaced bifurcated prongs 184 on each dial or knob, the angular distance between the holes in the arms of the hubs for both card sizes are spaced a multiple of 60°.

Returning to the manner of mounting the cover 162, this is accomplished by providing coaxial bearing holes 162' in the side walls of the cover, of a size to rotatably receive the outer one (172) of the coaxial flanges that project from the side walls of the housing. Since the side walls of the cover have considerable resilient flexibility, they can be spread apart sufficiently to enable the flanges 172 to be snapped into the bearing holes — of course, before the hubs are assembled with the rotor axle.

Those skilled in the art will appreciate that the invention can be embodied in forms other than as herein disclosed for purposes of illustration.

The invention is defined by the following claims.

We claim:

1. A card file wherein the cards are carried by a rotor mounted in a housing for rotation about a horizontal axis, characterized by:

A. the rotor having a plurality of tray carrying arms that project substantially radially from the rotor axis so that upon rotation of the rotor arms point downwardly as they traverse the lower part of their orbit;

B. a plurality of trays, one for each arm, having means thereon to hold a pack of file cards, and having front edges;

C. cooperating means on the arms and the trays freely slidably connecting the same and constraining the trays to movement along the arms towards and from the rotor axis and hence to and from a position fully engaged with the arms, in which position the front edges of the trays are their radially outermost extremities and travel in a circular orbit substantially concentric with the rotor axis as the rotor is turned; and D. inwardly facing track means in the lower portion of the housing spaced from the rotor axis a distance such that as the trays traverse that part of their orbit spanned by the track means the front edges of the trays are contiguous to said track means.

2. The card file of claim 1, wherein said curved track means is concentric to the rotor axis throughout the major portion of its length, and further characterized by:

cam means on a wall of the housing positioned to engage said front edge of a tray not fully in place on its rotor arm as the rotor is turned in the direction to carry said tray through the lower part of its orbit, and thereby slide the tray inwardly towards the rotor axis to a position at which its front edge is contiguous to the concentric portion of said track means.

3. The card file of claim 2, further characterized by:

releasable coacting latch means on the arms and their respective trays for releasably holding the trays against radially outward displacement on the arms, said latch means being located to become operative when the trays have reached substantially the position to which said cam means moves the same.

4. The card file of claim 3, wherein said latch means comprises a resilient tongue projecting from the radially outermost edge of each rotor arm and having an inwardly facing abrupt shoulder to engage an outwardly facing surface of a tray on the arm.

5. The card file of claim 1, wherein said housing has a curved wall that forms the front, bottom and rear portions of the housing, and further characterized in that said track means are formed by the edges of a plurality of laterally spaced fins formed integrally with the projecting from said curved wall, the distance said edges are spaced from the rotor axis being such that the front edges of the trays traversing the lower part of their orbit and also the top edge of the radially outermost cards in said trays ride on said edges as the rotor is turned.

6. The card file of claim 1, wherein a. the rotor has an axle with opposite ends, and b. the housing has at least one side wall with a hole therein through which one end of the rotor axle is accessible, and further characterized by:

A. means on said side wall providing a bearing for said one end of the rotor axle, said bearing being in line with the hole in said side wall;

B. a hub member journaled in said bearing and connected with said end of the rotor axle in a manner preventing relative rotation therebetween;

C. means for imparting rotation to the rotor and said hub member; and

D. detent means for releasably holding the rotor in one of a predetermined number of positions of rotation, comprising 1. a plurality of concentric circular flanges projecting from the exterior of said side wall coaxially with said bearing, each of said flanges having inner and outer cylindrical surfaces, 2. a cylindrical portion on said hub member, said cylindrical portion having inner and outer cylindrical surfaces and being coaxial with said concentric flanges, 3. the diameters of said cylindrical surfaces on the concentric flanges and on the cylindrical portion of the hub being of such relative dimensions that one of the cylindrical surfaces of one of said concentric flanges is relatively rotatably contiguous to one of the cylindrical surfaces of said cylindrical portion of the hub member, and 4. coacting protrusions and indentations on said contiguous cylindrical surfaces, interengageable by rotation of the hub member to releasably hold the hub member and the rotor against rotation.

7. The card file of claim 1, further characterized in that said card trays have interengageable male and female connection means at their opposite sides to enable the card trays upon detachment from the rotor arms, to be connected in side-by-side relation into a relatively rigid unit that may be placed on a desk top or other supporting surface to enable ready access to all of the cards carried by all of the trays.

8. The card file of claim 7, wherein said male and female connection means are interengageable dovetails.

9. The card file of claim 1, wherein each tray has a top wall with a top surface on which the cards are supported, and further characterized by a card follower on each tray movable fore-and-aft across said top surface, coacting means on said follower and said top wall forming a pivotal connection between the follower and said top wall that is slidable fore-and-aft along said top wall, so that the follower may be moved to a selected location, and means incorporated in said pivotal connection for selectively holding the follower in either a forwardly inclined or a rearwardly inclined posture.

10. A card file of the type having a base from which upright front and rear walls and opposite side walls rise to define a housing with an upwardly facing access opening, and a rotor supported in the housing by said side walls for rotation about a horizontal axis, the rotor having a plurality of arms radiating from its axis with card carrying trays detachably mounted thereon, so that by rotation of the rotor any selected card carrying tray can be brought to a substantially horizontally disposed viewing position in juxtaposition to said access opening, and characterized by:

A. the housing side walls having axially aligned holes therethrough providing bearings in which the rotor is journaled;

B. said rotor being an assembly comprising 1. an axle which extends transversely across the interior of the housing coaxially with said holes but does not protrude beyond the outer ends of the holes and has the radiating arms of the rotor projecting therefrom, 2. axle support members at the ends of the axle, said axle support members having head and hub portions, the latter being journaled in said holes in the housing said walls, 3. means connecting the axle support members with the opposite ends of the axle comprising male and female elements that are interengageable upon inward insertion of the hub portions of the axle support members into said holes, and 4. cooperating interengageable retaining means of the axle support members and the axle automatically rendered effective in consequence of said inward insertion of the hub portions of the axle support members into the holes to hold the axle support members against detachment from the axle.

11. The card file of claim 10, further characterized by means on said male and female elements, which upon interengagement of said elements, prevent relative rotation between the axle and its support members, and further characterized by a rotor-turning knob secured to the head portion of at least one of said axle support members.

12. A card file of the type having a base from which upright front and rear walls and opposite side walls rise to define a housing with an upwardly facing access opening, and a rotor within the housing supported by said side walls for rotation about a horizontal axis, characterized by:

A. said rotor being an assembly comprising
1. an axle which extends transversely across the interior of the housing,
2. axle support members journaled in the housing side walls for rotation on a common transverse axis, at least one of said axle support members being accessible from the exterior of the housing side wall in which it is journaled,
3. means connecting the opposite ends of the axle with said axle support members in a manner preventing displacement of the latter from the former, and
4. means providing a rotation transmitting connection between said one of said axle support members and the axle;

B. a knob connected with said one of said axle support members at the exterior of the housing, for transmitting rotary movement to the rotor through said one axle support member;

C. a card carrying tray connected with the rotor to be carried thereby upon rotation of the rotor to and from a viewing station adjacent to said access opening of the housing; and D. detent means for releasably holding the rotor in a position of rotation at which said tray is at the viewing station, said detent means comprising
1. a rim on said one of said axle support members concentric to the rotor axis,
2. a flange on the exterior of the housing side wall adjacent to said one axle support member, said flange being concentric to the rotor axis and spaced from said rim, and
3. cooperating detent elements on said rim and flange.

13. The card file of claim 12, wherein a plurality of said trays are connected with the rotor at angularly equispaced locations and to rotate therewith, and wherein said detent means arrests rotation of the rotor at a plurality of angular positions corresponding to the number of trays, at each of which a different one of the trays is at said viewing station.

14. A card file wherein the cards are carried by a rotor mounted on a base for rotation about a horizontal axis, characterized by:

A. a plurality of outwardly projecting tray supporting arms on the rotor;

B. a plurality of trays, one for each arm, having means thereon to hold a pack of file cards;

C. cooperating means on the arms and trays supporting the latter in operative positions on their respective arms and providing for detachment of the trays therefrom;

D. releasable latch means on the arms and their respective trays for releasably holding the latter in their operative positions;

E. and cam means operative during rotation of the rotor in one direction to effect return of a replaced tray to its operative latched position from a position displaced a short distance therefrom.

* * * * *